US007980913B1

(12) United States Patent
D'Avanzo

(10) Patent No.: US 7,980,913 B1
(45) Date of Patent: Jul. 19, 2011

(54) ELECTRONIC INTERACTIVE PLAY CITY

(75) Inventor: Scott D'Avanzo, Ladera Ranch, CA (US)

(73) Assignee: Adrenalin Gaming, LLC, Ladera Ranch, CA (US)

( * ) Notice: Subject to any disclaimer, the term of this patent is extended or adjusted under 35 U.S.C. 154(b) by 1362 days.

(21) Appl. No.: 11/459,901

(22) Filed: Jul. 25, 2006

(51) Int. Cl.
*A63H 30/04* (2006.01)
*A63H 33/00* (2006.01)

(52) U.S. Cl. ..... 446/85; 446/91; 446/175

(58) Field of Classification Search ..... 446/175, 446/268, 118, 85, 484, 130, 91; 463/63; 52/750; *A63H 30/00, 33/04*
See application file for complete search history.

(56) References Cited

U.S. PATENT DOCUMENTS 5,788,553 A * 8/1998 Shivers et al. ..... 446/91
5,931,338 A * 8/1999 Hoeting et al. ..... 221/24
6,129,605 A * 10/2000 Cyrus et al. ..... 446/118
6,194,995 B1 * 2/2001 Gates ..... 340/309.7
6,227,931 B1 * 5/2001 Shackelford ..... 446/268
6,443,796 B1 * 9/2002 Shackelford ..... 446/91
6,659,836 B1 * 12/2003 Yamasaki et al. ..... 446/175
6,780,078 B2 * 8/2004 Hageman et al. ..... 446/175
7,033,243 B2 * 4/2006 Hornsby et al. ..... 446/484
2005/0227577 A1 * 10/2005 McRae ..... 446/268
2006/0246403 A1 * 11/2006 Monpouet et al. ..... 434/128

* cited by examiner

*Primary Examiner* — Dmitry Suhol
*Assistant Examiner* — Alex F. R. P. Rada, II
(74) *Attorney, Agent, or Firm* — Greenberg Traurig

(57) ABSTRACT

A an interactive play city is disclosed. The play city can act as an educational play or be played as a game. In either case, the play city is formed of connectable members used to form streets and building foundations. Buildings are then connectable to the certain connectable members to form the city. A control unit (e.g., processor) controls city activities including stop lights and building lights, emergency alarms, fires with smoke, day and night, city sound effects, storm sounds, etc. The control unit may control the city activities wirelessly or in a wired configuration and may be housed in one of the city buildings or may be remotely located. Card readers on certain buildings (e.g., bank) provide a mechanism for players to purchase goods and services within the city. The play city provides a realistic forum for children to become associated with everyday life and its ups and downs. A play city game further provides valuable lessons for the players.

58 Claims, 16 Drawing Sheets

Fig. 2 (top of automobile-led/lcd fuel indicator)

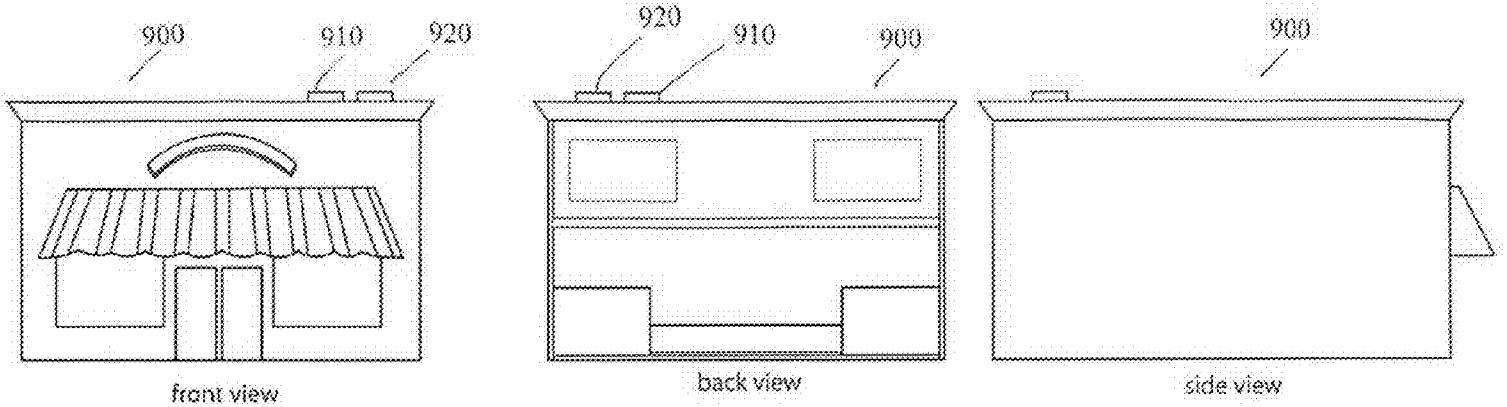
Fig. 15a
Fig. 15b
Fig. 15c
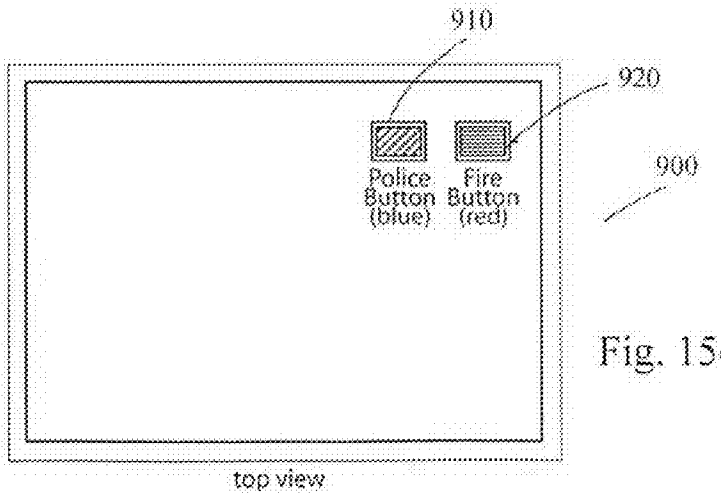
Fig. 15d

ELECTRONIC INTERACTIVE PLAY CITY

FIELD OF THE INVENTION

The embodiments of the present invention relate to an electronic play designed to entertain and educate children. More particularly, the electronic play city is modular and is controlled by a central processor such that children are able to build and run interactive cities.

BACKGROUND

Plays have matured from conventional physical types (e.g., erector sets or tinker plays) to video games and similar pure electronic games. Unfortunately, many experts believe that video games provide no educational benefit and encourage anti-social or violent behavior. Accordingly, many parents are hesitant to purchase such games. On the other hand, most educational games tend to bore children and therefore do not provide a desired level of teaching.

Thus, there is a need for an interactive, modern play that educates and entertains children.

SUMMARY

Accordingly, one system embodiment of the present invention comprising: a control unit; a series of planar connectable members having connectable devices, said connectable members operable to connect to one another to form a city foundation; a series of buildings having connector means for connecting the buildings to certain of the connectable members; and wherein the control unit is operable to control certain activities within the city.

In a practical embodiment, children are able to construct scaled cities using modular components. The one or more central processors control different features, including emergencies, payroll and gas distributions, of the constructed city. The children interactively control different features of the city as well. In the process, the children learn the responsibilities that face adults in everyday life. Besides providing valuable educational experience with respect to day-to-day life situations, it also enables children, at a young age, to appreciate and respect the day-to-day efforts of their parents.

Other variations, embodiments and features of the present invention will become evident from the following detailed description, drawings and claims.

BRIEF DESCRIPTION OF THE DRAWINGS

FIGS. 15*a*-15*d* show a front view, back view, side view and top view, respectively, of an emergency building.

DETAILED DESCRIPTION

Figure 1:
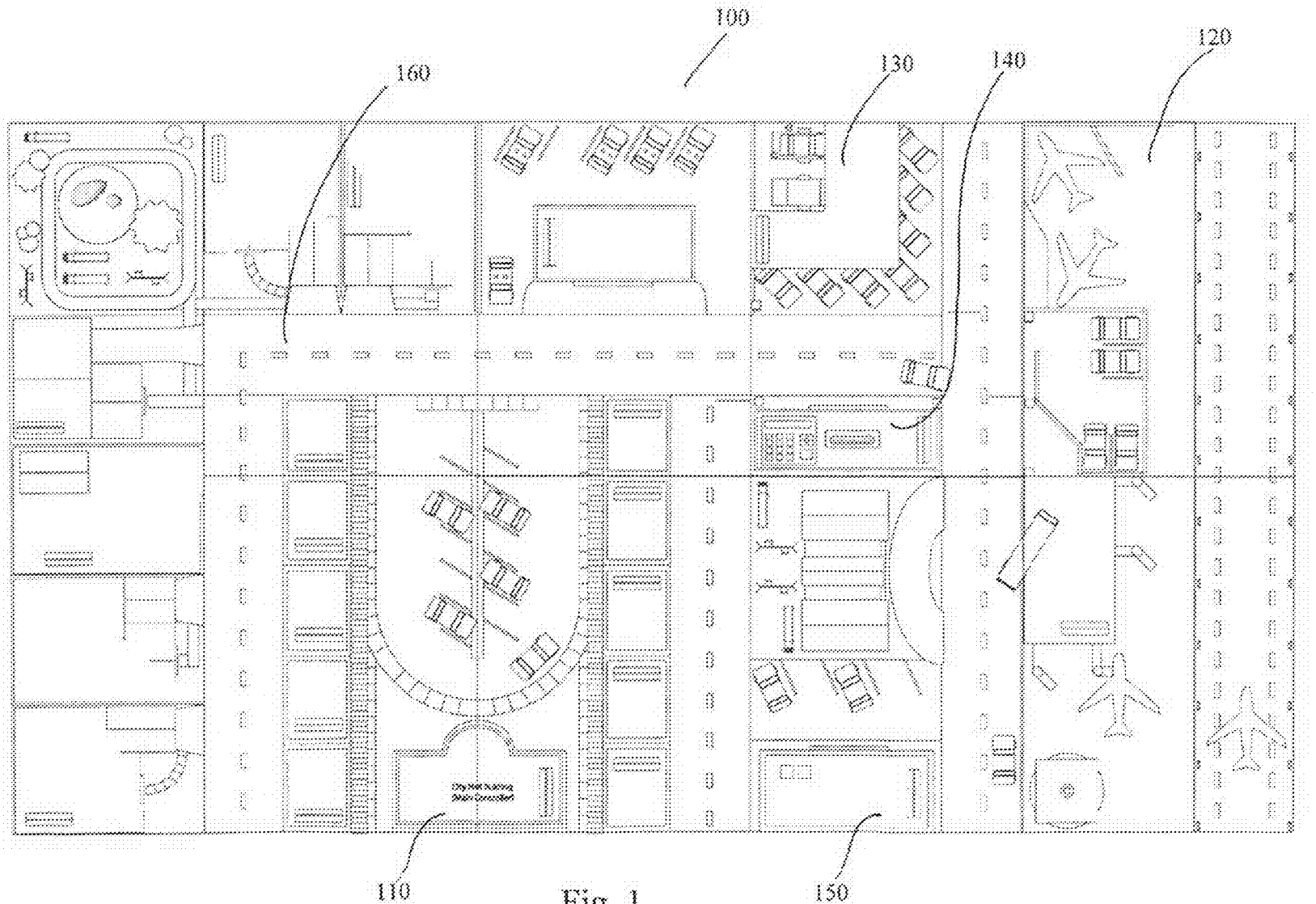
FIG. 1 illustrates an overhead view of an assembled city.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to a person skilled in the relevant art and having possession of this disclosure, are to be considered within the scope of the invention claimed.

As described in much greater detail below, the embodiments of the present invention are facilitated by one or more processors, microprocessors or controllers linked to various city components. The processors or microprocessors are of a conventional type configured and programmed to provide an interactive experience via the various city components. The processors or microprocessors may be fully pre-programmed or may allow users to coordinate certain city activities to the user's desires. The city may be wired or wireless or a combination thereof.

The embodiments of the present invention may facilitate entertainment, education and/or competition in a game format. A play city provides a game or play for children whereby the children are initiated to the "real world." For example, earned monies are used to purchase goods and services. The play city, like a real city, includes homes, businesses, vehicles, aircraft, watercraft, people and numerous other items. The microprocessors control, among other things, city actions like street lights, stop lights, emergency warnings, day and night and weather effects.

Reference is now made to the figures wherein like parts are referred to by like numerals throughout. FIG. 1 shows an overhead view of an assembled play or play city generally designated by reference numeral 100. As shown, the assembled city 100 includes a city hall building 110, airport 120, fire station 130, bank building 140, gas stations 150 and roads 160. In this configuration, the city hall building 110 serves as the city's hub and incorporates one or more central processors or controllers for controlling the activities of the city. Multiple card readers 170 provide means for users to access money and pay for items for reasons described in greater detail below. Each card reader 170 communicates with the one or more processors and/or memory or storage capability linked thereto. The memory or storage may be embedded in the one or more processors as well.

The city hall processors control night and day by turning on and off lights at regular intervals (e.g. two minutes). Day and night is dictated by turning on and off street lights and building lights. For example, a day in the play city 100 may last four minutes such that a week lasts 28 minutes. In one embodiment, an audible announcement, "Its Payday" is triggered by the processor. The announcement reminds businesses to pay employees and also reminds players to pay their rent or other bills such a tickets. The audible messages may include other announcements, such as storm sounds, other city sounds, burglar alarms and notices of emergency. In a game embodiment detailed below, the audible messages are game related (e.g., "roll the dice").

The main controller also controls city features such as traffic lights and creation of smoke indicating a fire. Those skilled in the art will recognize that any play city member or building may integrate the main controller. Alternatively, the main controller may be remote from all city buildings.

Figure 2:
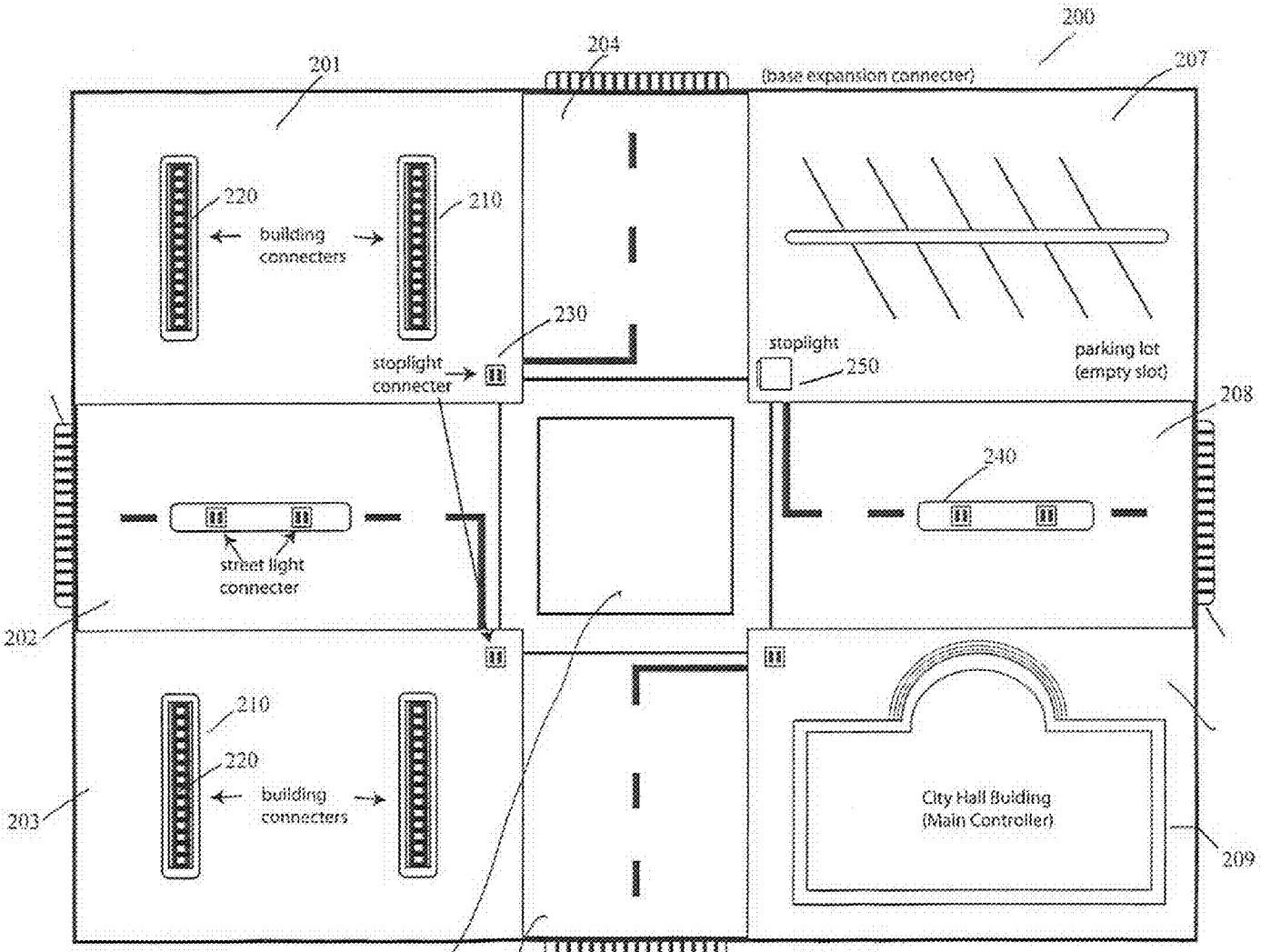
FIG. 2 illustrates an overhead view of a base member for receiving play city components.

FIG. 2 shows a group of individual connectable members 201 through 209 connected to one another to form a portion of the assembled city 100. As shown, the base member 200 supports the city hall building 110 situated thereon. Certain connectable members 201 and 203 also include building connectors 210 for linking buildings to the central controller or processor. The city hall building 110 is connected to connectable member 209 (concealed in FIG. 2) as described hereinafter. As shown, the connectors 210 are female multi-pin receivers which accept male multi-pin extensions 220 on undersides of said buildings. The connections permit the main controller to communicate with the buildings and vice versa. Optionally, other buildings may incorporate processors and/or controllers as well. In addition to the building connectors 210, dual female ports 230, 240 are strategically positioned to receive dual male ports (not shown) of individual traffic or stop lights 250 and street lights 260, respectively. A traffic light 250 is shown in place. As set forth above, the main controller is responsible for controlling the stoplights 250, street lights 260, storm sounds, building lights, emergency calls, audible alarms, smoke and audible messages.

Figure 3:
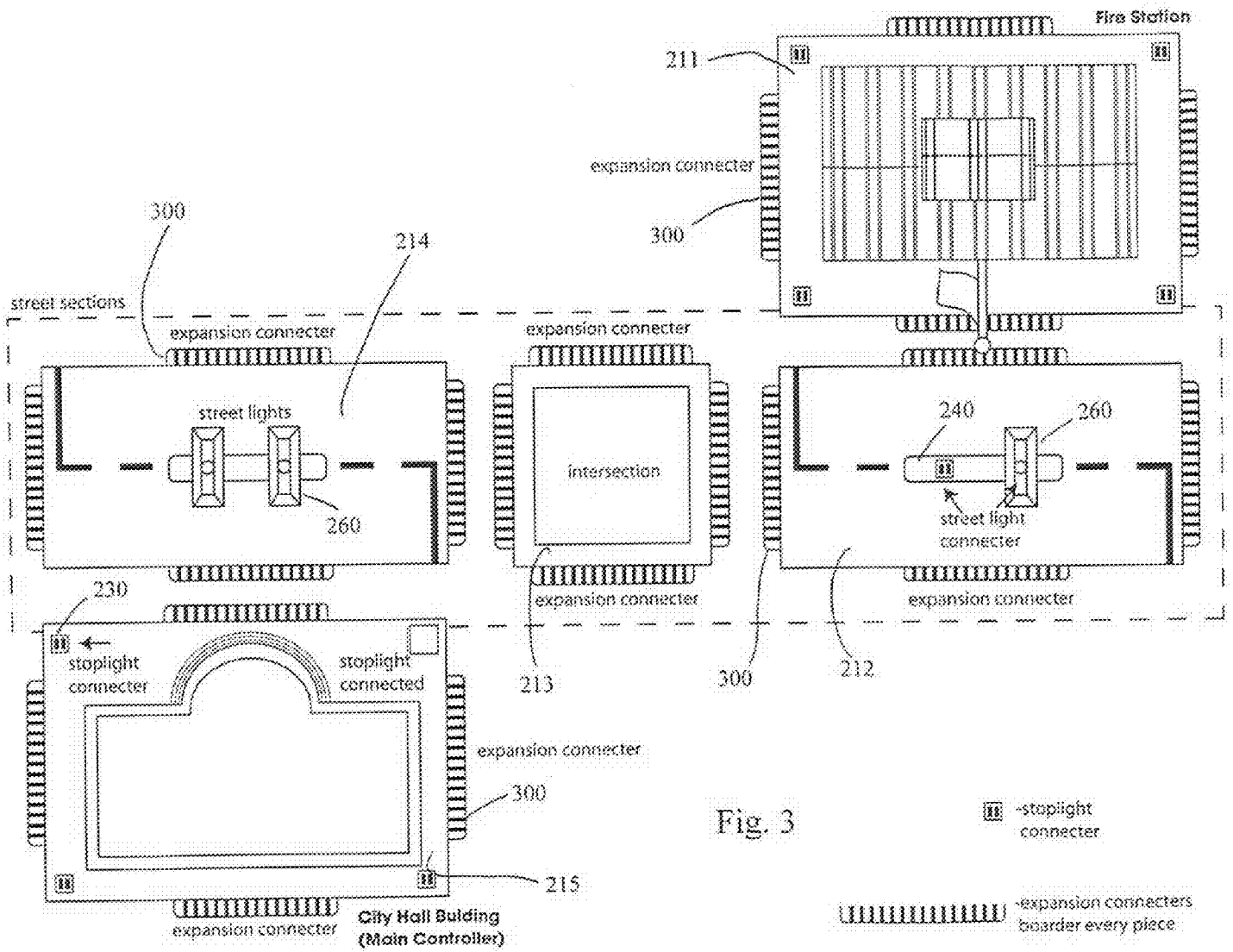
FIG. 3 illustrates an overhead view of multiple disconnected modules used to assemble a city.
Figure 4A:
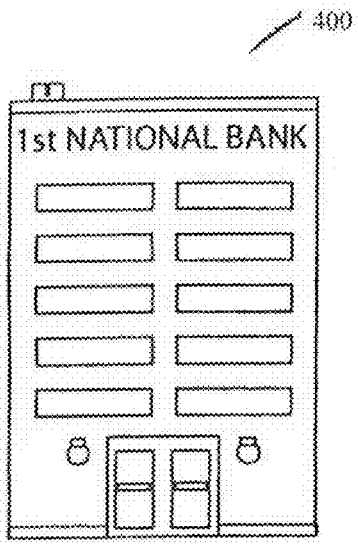
FIGS. 4*a*-4*d* illustrate a bank building.
Figure 4B:
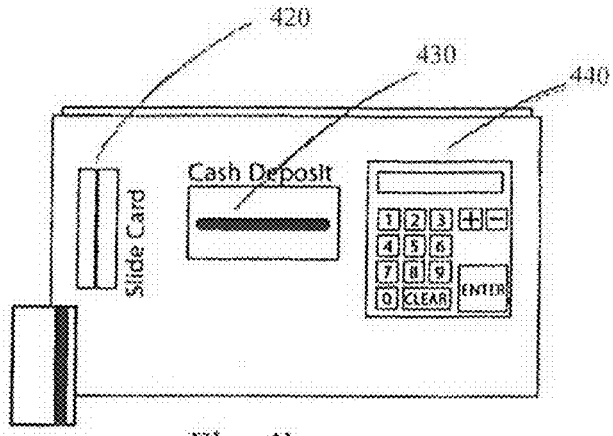
Figure 4C:
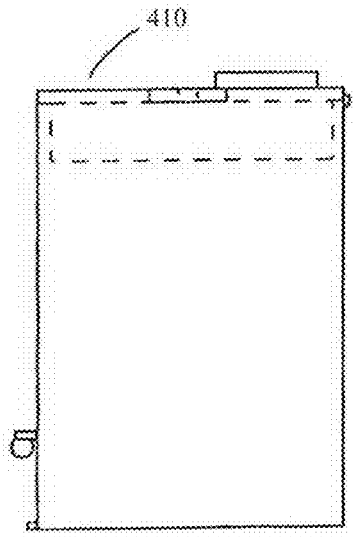
Figure 4D:
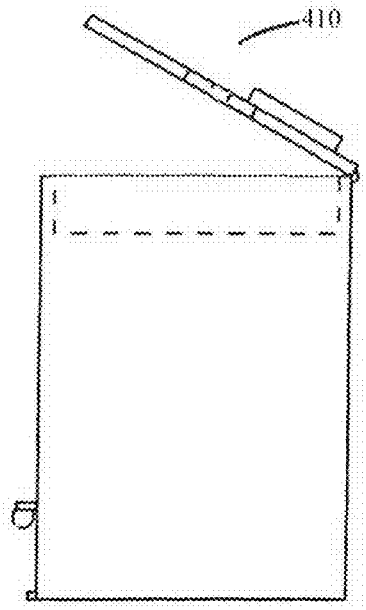

FIG. 3 shows individual connectable members 211 through 215 unconnected. Each unconnected member 211 through 215 includes multiple expansion connectors 300. The connectors 300 snap together with one another to securely join the connectable members 211 through 215 and others. Connectable members 212 through 214 are street members including street light connectors or ports 240 for receipt of street lights 270. Traffic light connectors or ports 230 are integrated into connectable members 211 (City Hall) and 215 (Fire Station).

While horizontal elongated connectors 300 are shown, any type of suitable connector may be used to join the connectable members 211 through 215 and others. In a wired system, the connectors 300 include contacts which facilitate communications between the various connectable members, street lights 260, traffic lights 250 and other items with the main controller. The communications may also be facilitated by a wireless system using transmitters and receivers with infrared, radio, Bluetooth or similar technology.

FIGS. 4*a*-4*d* show a bank building 400 of the present invention. The bank building 400 includes an interactive top surface 410 supporting a credit or bank card reader 420, cash deposit slot 430 and touch pad 440 operable to manage a user's account. The card reader 420 is operable to read bank and credit type cards issued to users, display balances and confirm deposit and withdraw amounts. The cash deposit slot 430 accepts cash deposits and the touch pad 440 allows users to type in deposit and withdraw amounts and use a PIN to deposit or withdraw cash. The top surface 410 can be opened, with a key, to withdraw cash or conduct maintenance on the bank building 400. Opening the top surface without a key triggers an alarm. Any and all buildings may have a similar feature whereby the building is secured. The objective of the bank building 400 is to teach players respect for money and to encourage money savings. Interest accumulates on maintained balances again teaching younger individuals the benefits of saving money. While the bank building 400 is shown with the card reader 420, any building may be fitted with a card reader 420. The card reader 420 operates in a conventional fashion as known to those skilled in the art.

Figure 5B:
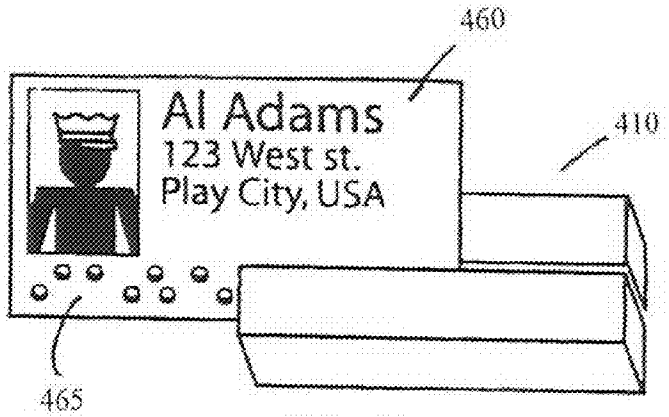
FIGS. 5*a*-5*d* illustrate a card reader and corresponding cards.
Figure 5D:
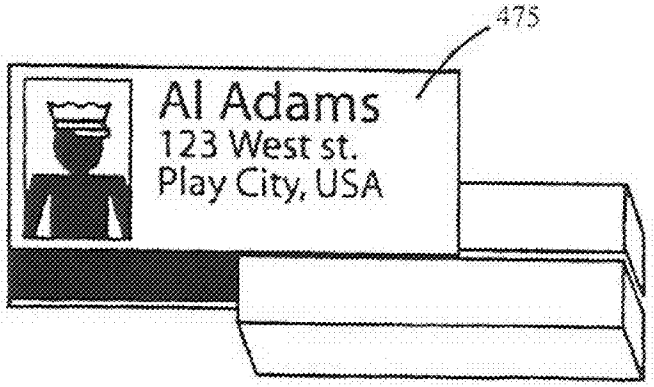
Figure 5A:
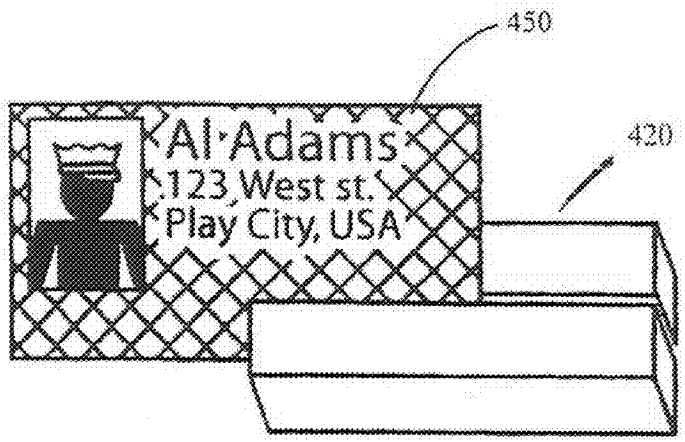
Figure 5C:
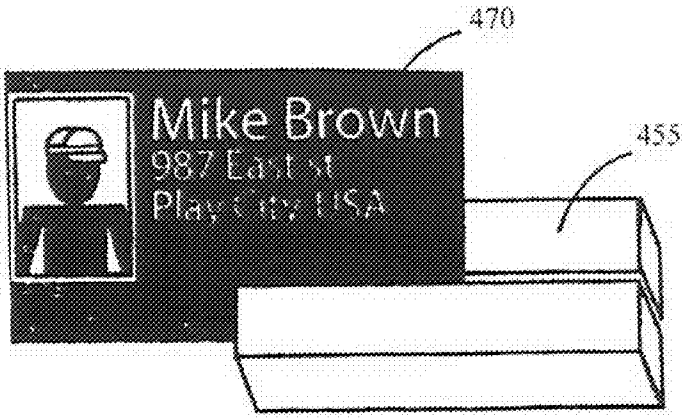

FIGS. 5*a*-5*d* show multiple unique card types which may be used with said card reader 420 and similar readers placed throughout the play city 100. FIG. 5*a* shows a card 450 having a magnetic strip 455 that retains user data. FIG. 5*b* shows a card 460 having a series of punches or openings 465 which, based on their pattern, store user data. FIGS. 5*c* and 5*d* show cards 470, 475 having different colors, indicating different types of cards such as credit and debit and/or to allow players to keep track of which card belongs to which player.

Figure 6A:
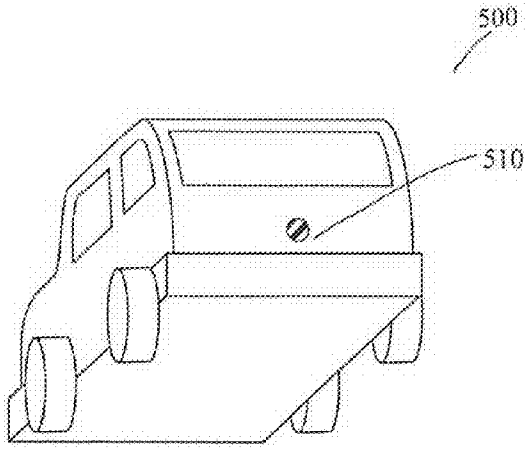
FIGS. 6*a*-6*e* illustrate an automobile and corresponding fuel indicator.
Figure 6B:
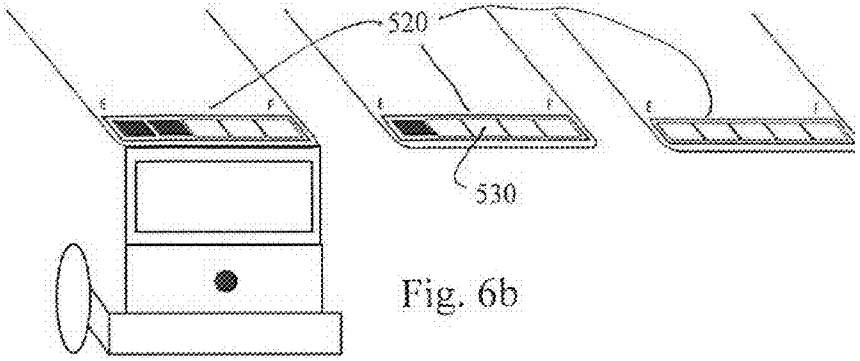
Figure 6C:
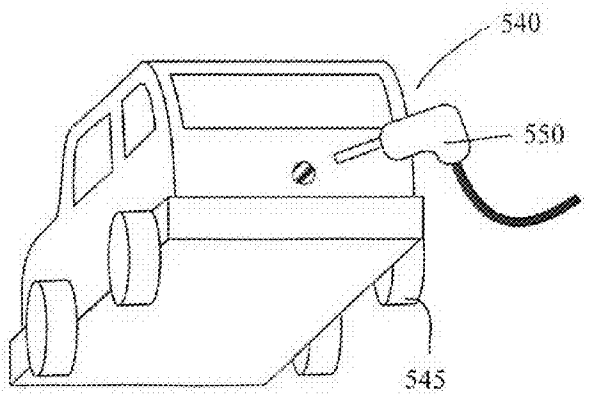
Figure 6D:
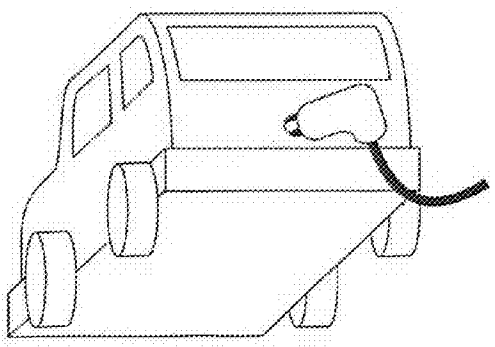
Figure 6E:
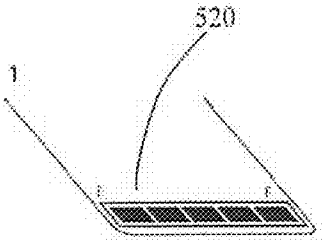
Figure 7B:
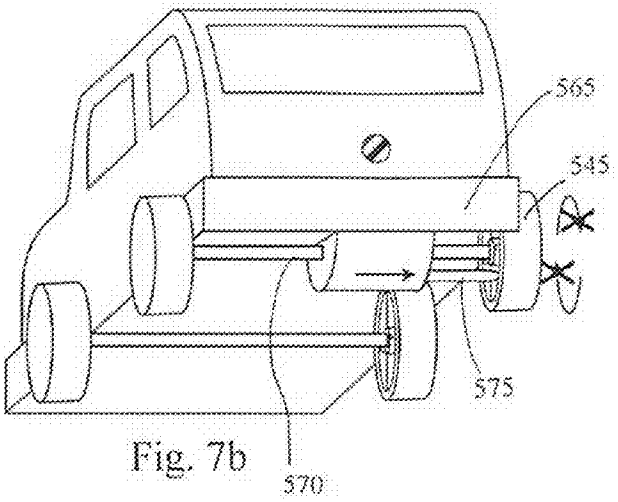
FIGS. 7*a*-7*d* illustrate a drive system of the automobile of FIGS. 6*a*-6*e;*
Figure 7D:
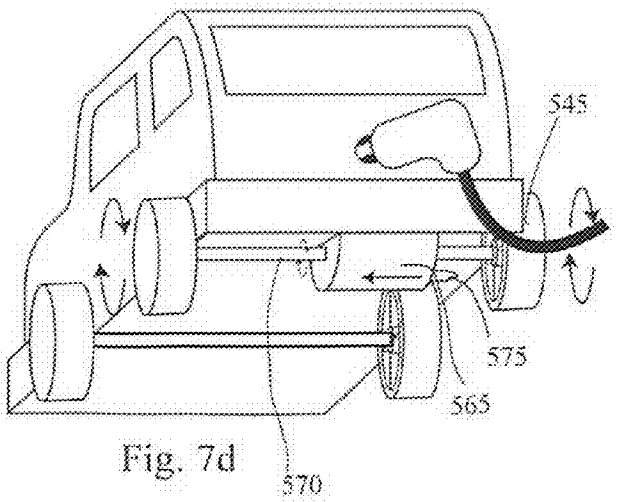
Figure 7A:
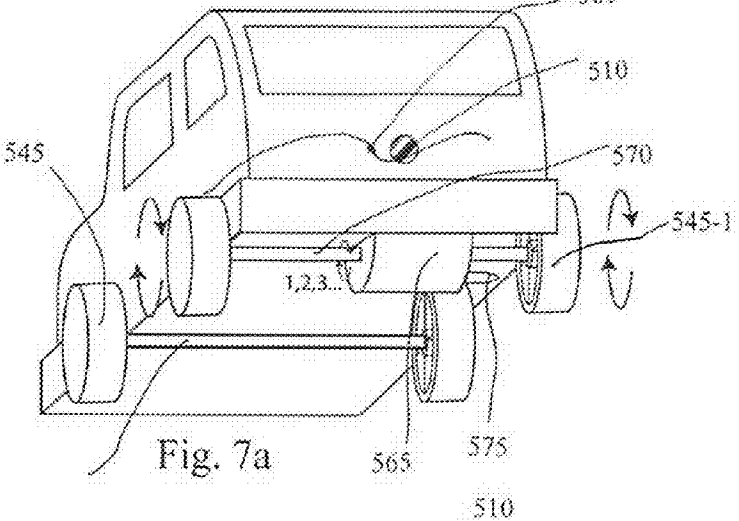
Figure 7C:
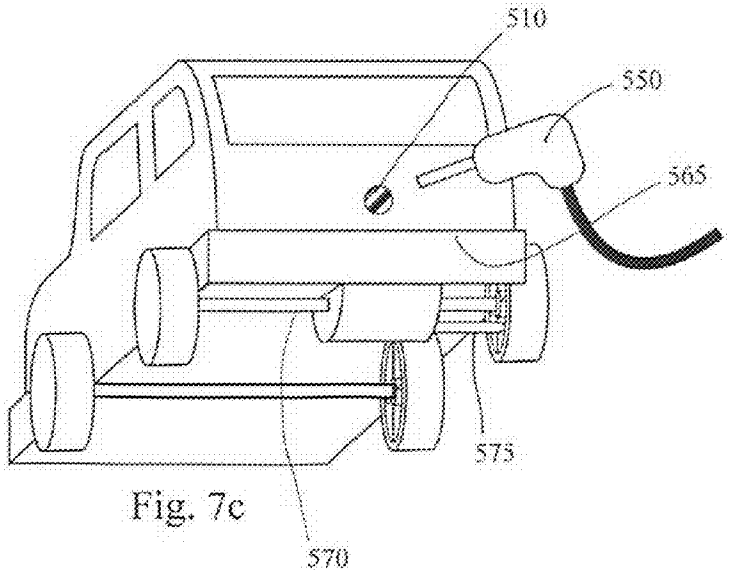
Figure 9B:
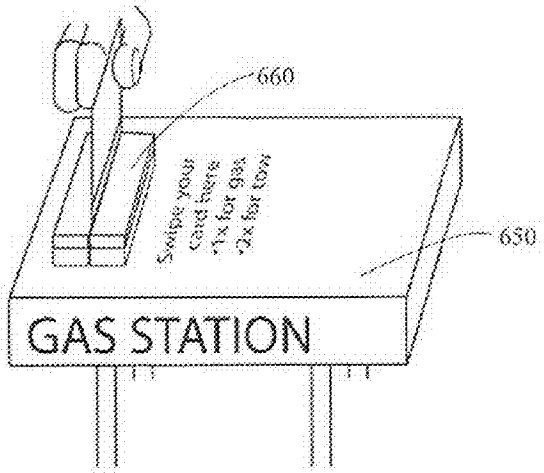
FIGS. 9*a*-9*c* illustrate a gas station.
Figure 9A:
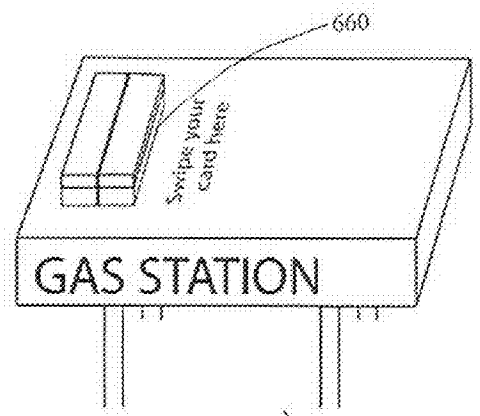
Figure 9C:
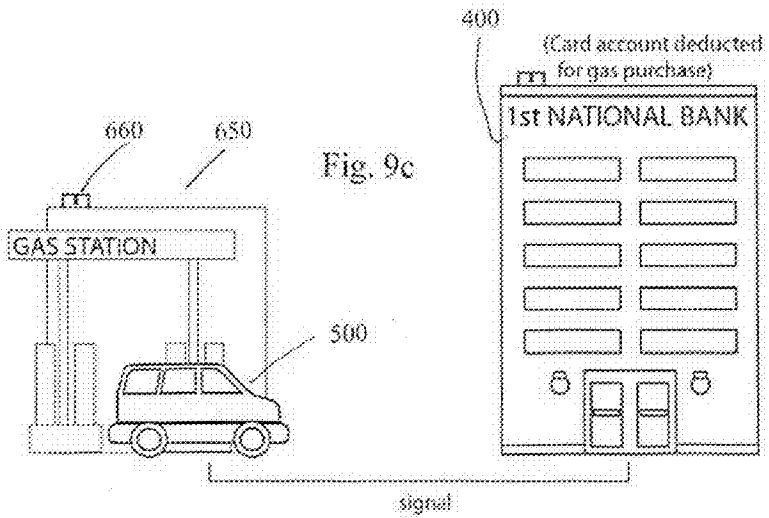
Figure 10A:
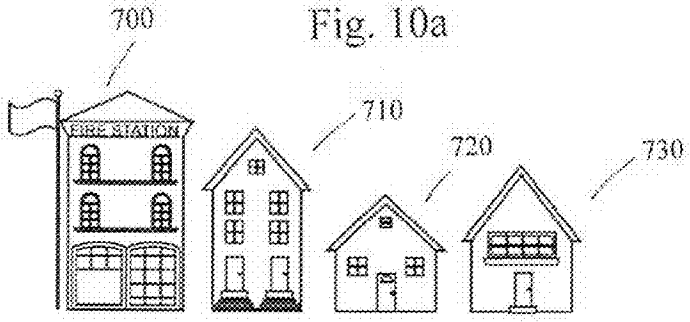
FIGS. 10*a*-10*d* illustrate a fire station.
Figure 10B:
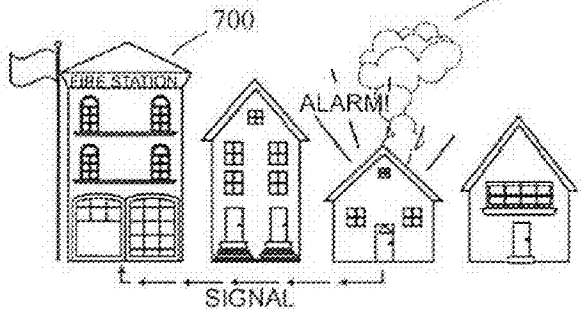
Figure 10C:
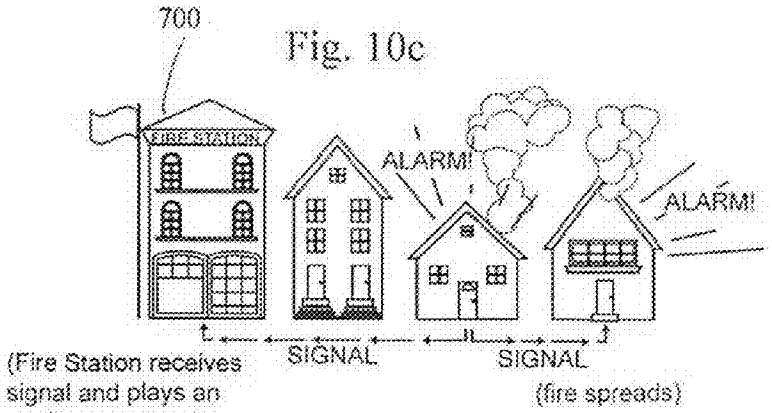
Figure 10D:
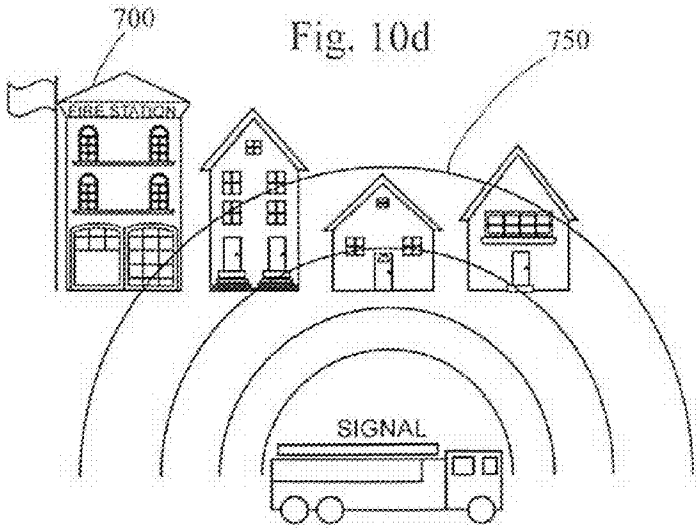
Figure 11A:
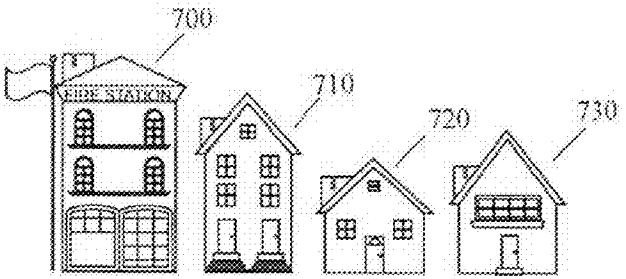
FIGS. 11*a*-11*f* illustrate a fire station and a first method of extinguishing a fire.
Figure 11B:
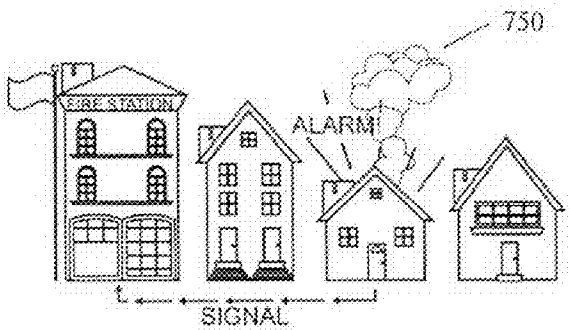
Figure 11C:
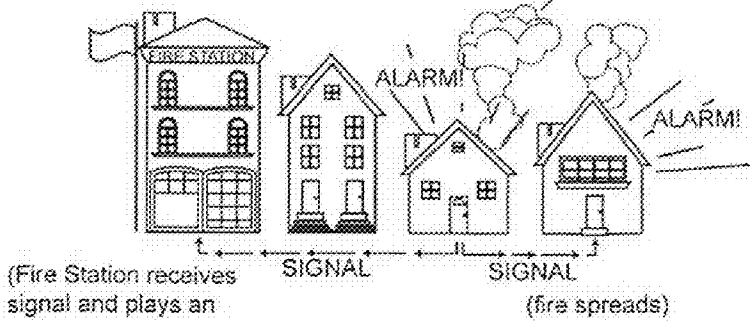
Figure 11D:
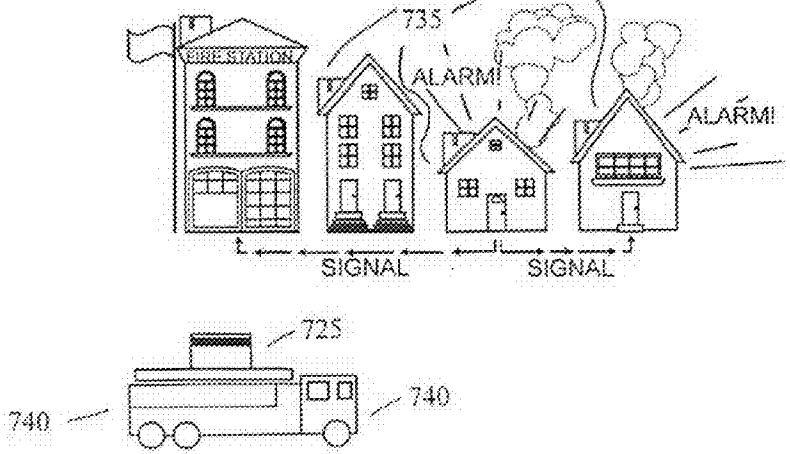
Figure 11F:
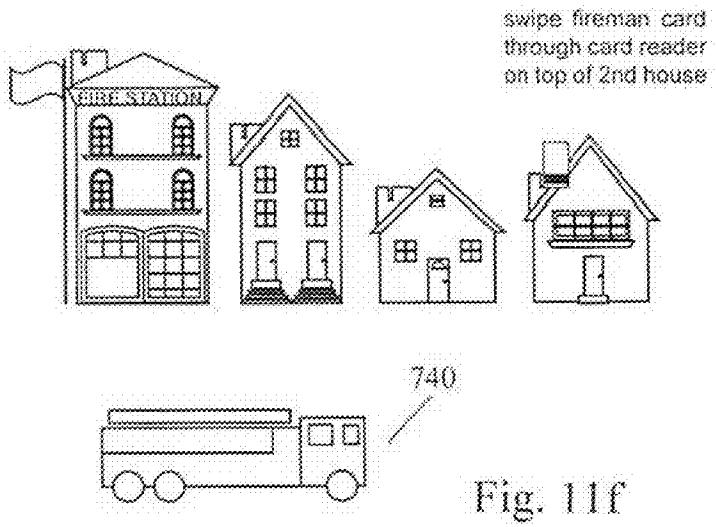
Figure 11E:
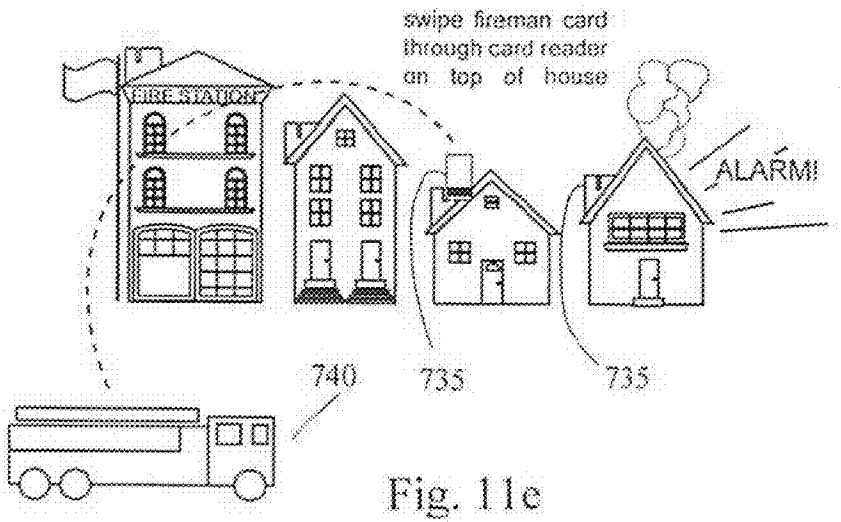

FIGS. 6*a*-6*e* show an exemplary automobile 500 of the present invention. FIG. 6*a* shows a rear portion of the automobile 500 having a fuel intake opening 510. FIG. 6*b* shows an upper portion of the automobile 500 with a fuel indicator 520 visible. The fuel indicator 520 is formed of a series of LED or LCD panels 530. The fuel intake opening 510 does not accept liquid fuel but rather accepts an unlocking tool 540. As shown, the fuel indicator 520 includes five panels 530 indicating the amount of power remaining prior to the automobile 500 running out. FIGS. 6*c* and 6*d* show the fuel intake opening 510 accepting an unlocking tool 540 in the shape of a gas nozzle 550. The tool 540 unlocks the rear wheels 545, which as shown in FIGS. 7*a*-7*d*, are locked when the charge indicator 520 reads empty. FIG. 6*e* shows the fuel indicator 520 at a full charge after the tool is used. The automobiles 500, may have working headlights as well and positions for the placement of human figures (not shown). As shown in FIGS. 9*a*-9*c*, a card reader connected to a fuel station is used to pay for the new charge.

Optional charging bays accommodate and provide a means for charging the automobiles 500. The charging bays include charging contacts which correspond to charging contacts on the automobiles 500. Ideally, the automobiles 500 sit on the charging bays and charge over time.

FIGS. 7*a*-7*d* show a drive system 560 of the automobile 500. The drive system 560 comprises a translatable member 565 connected to a rear axle 570. The translatable member 565 translates from a central position outward as the car is manually maneuvered around the city 100. The translatable member 565 includes an articulating arm 575. As the charge is shown to decrease, the articulating member 575 continues to move toward a rear wheel 545-1 preventing one or both rear wheels 545 from rotating thereby stalling the automobile 500 at that location representing no fuel. It is also conceivable that the automobiles 500 may be electrically powered or powered with conventional batteries or rechargeable batteries. In such a system, the automobiles 500 may be controlled by a handheld steering and speed unit. Human figures (not shown) can be placed in the automobiles 500.

Figure 8A:
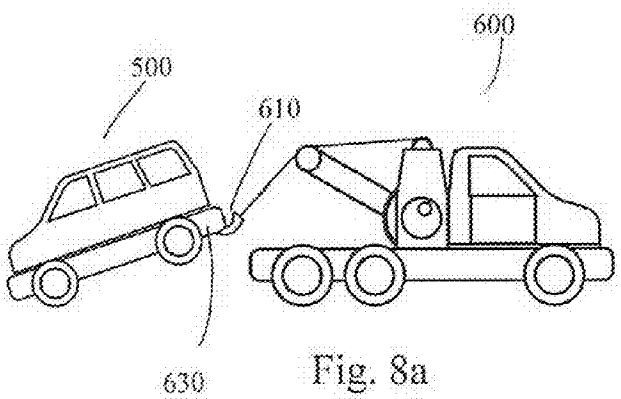
FIGS. 8*a*-8*d* illustrate a tow truck.
Figure 8B:
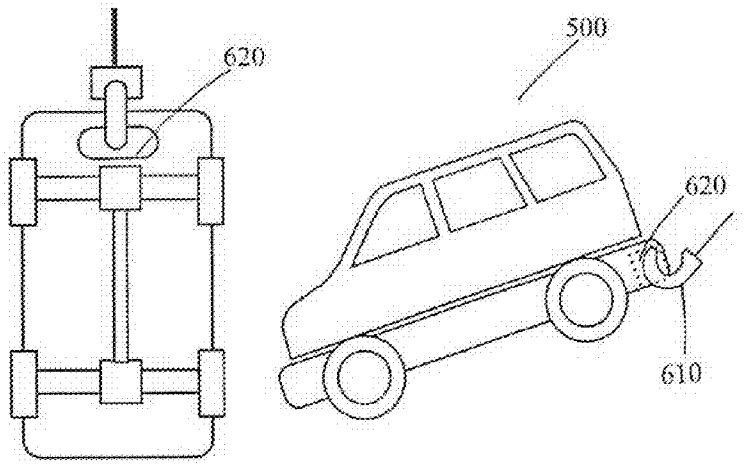
Figure 8C:
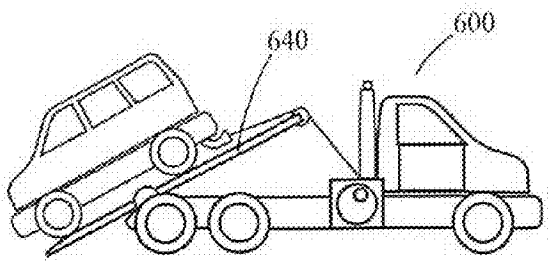
Figure 8D:
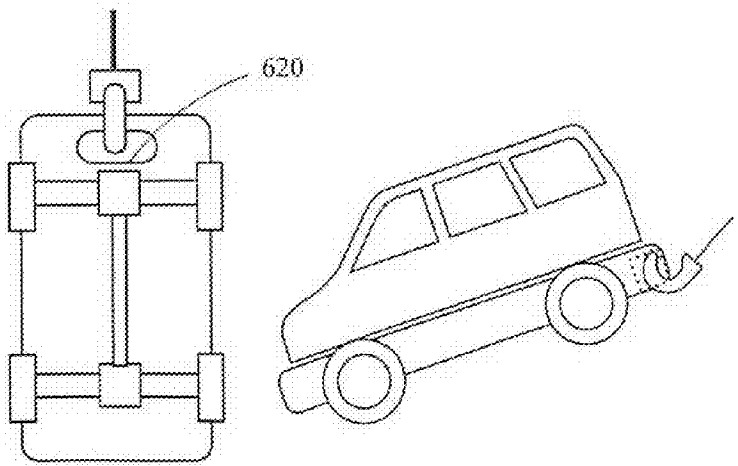

FIGS. 8*a*-8*d* show a tow truck 600 of the present invention. The tow truck 600 includes a hook 610 for engaging an opening 620 beneath a rear bumper 630 of the automobile 500. FIG. 8*c* shows a tow truck 600 having a flat bed 640 for transporting the automobile 600. Utilizing the tow truck 600 requires use of a card reader and corresponding card to pay for the tow service. The tow truck 600 operates in the same manner as the automobiles 500.

FIGS. 9*a*-9*c* show a gas station 650 and integrated card reader 660. The card reader 660 is, like the others, linked to the bank building 400 via a wireless or wired connection. The link allows monies to be deducted from a bank account associated with the card used to pay for the fuel.

FIGS. 10*a*-10*d* show a fire station 700 neighboring several houses 710-730. One or more of the houses 710-730 are linked to the fire station 700 via a wireless or wired connection. Via a random program or manual method, a building alarm sounds and a smoke 735 indicating a fire is dispensed from a building, in this instance, building 710. Simultaneously, a signal is transmitted to the fire station 700 causing an audible message corresponding to the fire to be played. By moving a fire truck 740 to the vicinity of the fire, the fire is extinguished based on a signal 750 transmitted from the fire truck 740 to the house 710. In this case, as the fire truck 740 was late in arriving to the scene, building 730 was also on fire. Accordingly, the signal 750 causes both building fires to be extinguished.

FIGS. 11*a*-11*f* shows the fire station 700 neighboring several houses 710-730. In this configuration, a card 725 retained by the fire truck 740 is used to extinguish the fires by swiping the card 725 through card readers 735 located on the houses 710-730. The read data causes the fire to extinguish.

Figure 12B:
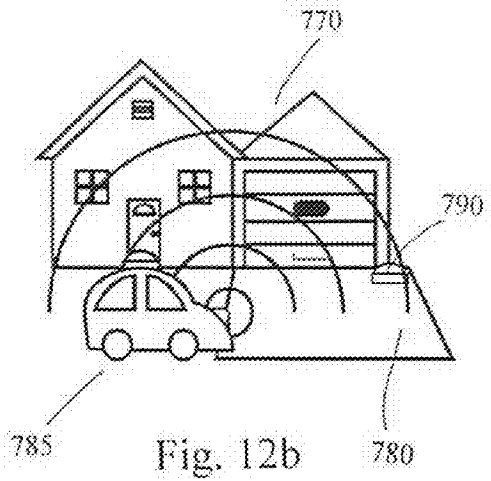
FIGS. 12*a*-12*c* illustrate the fire station and a second method of extinguishing a fire.
Figure 12A:
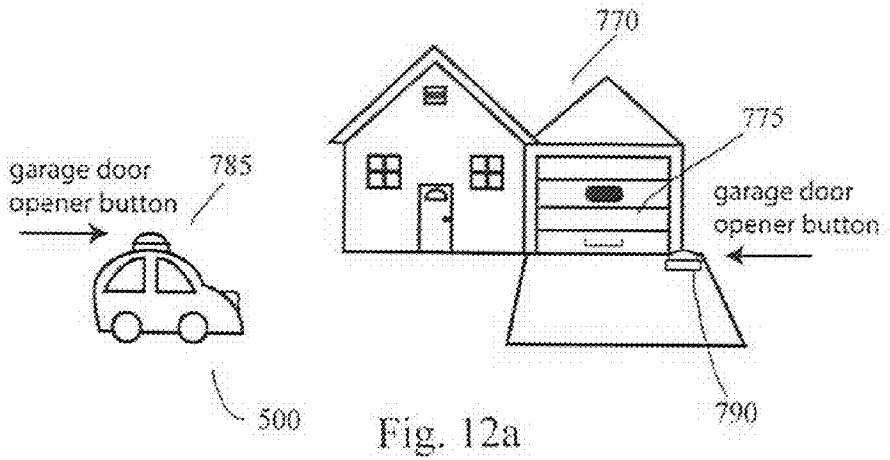
Figure 12C:
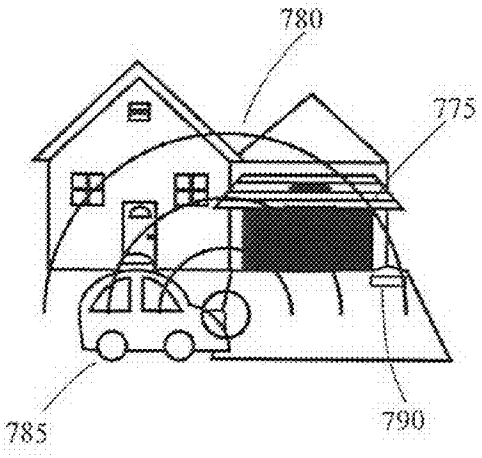

FIGS. 12*a*-12*c* show a garage 770 and a method for opening a garage door 775. As shown, the automobile 780 includes a button 785 for opening the garage door 775. A second button 790 is positioned near the garage door 775 in the driveway 795.

Figure 13B:
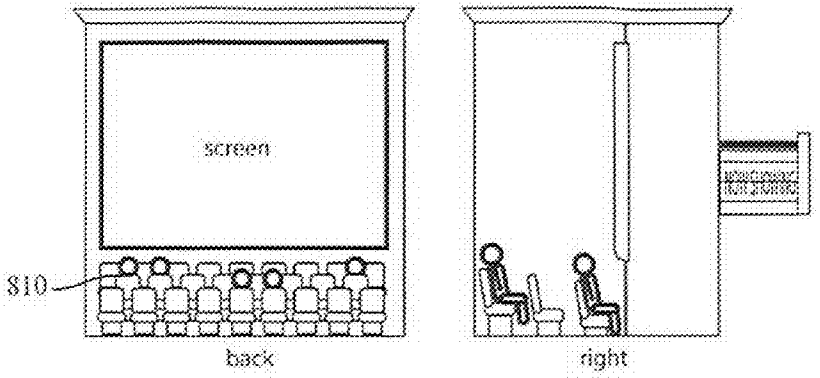
FIGS. 13*a*-13*d* illustrate a indoor movie theatre.
Figure 13D:
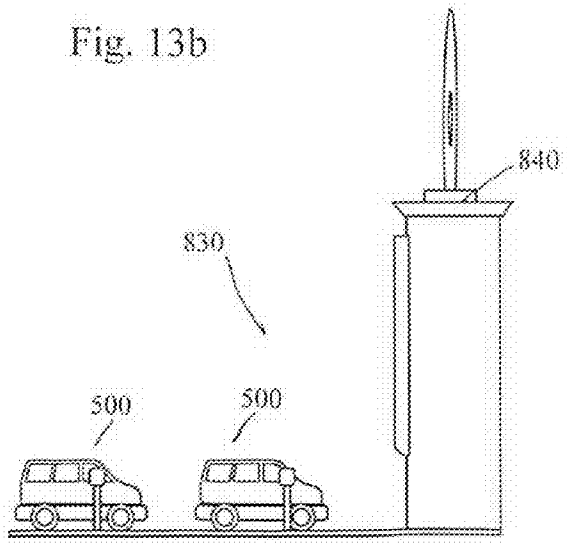
Figure 13A:
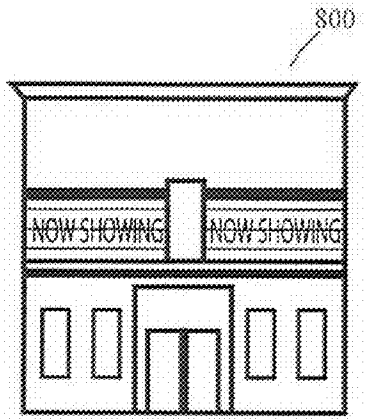
Figure 13C:
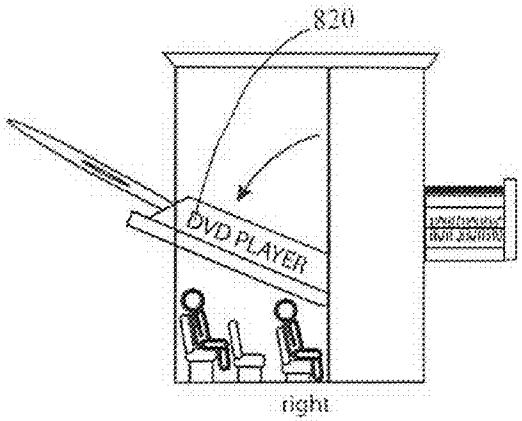
Figure 14A:
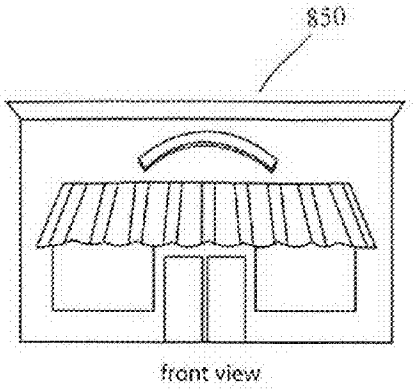
FIGS. 14*a*-14*e* illustrate a front view, back view, side view and multiple top views, respectively, of a candy dispenser.
Figure 14B:
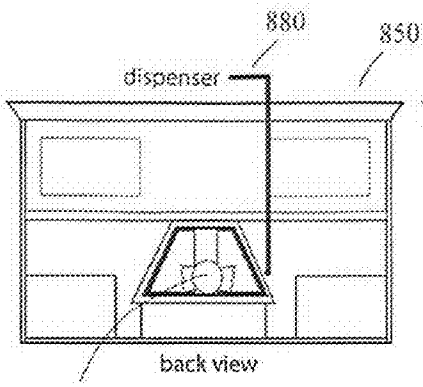
Figure 14C:
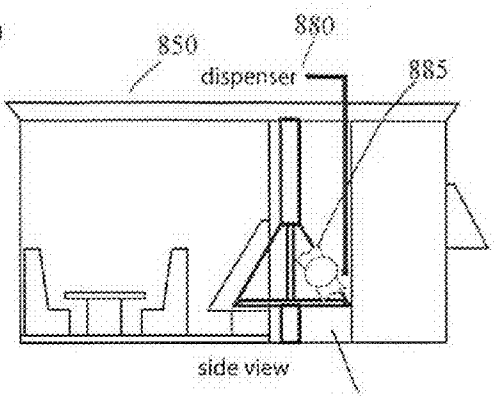
Figure 14D:
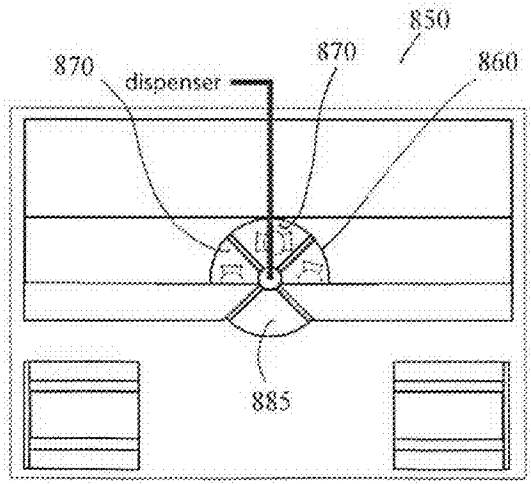
Figure 14E:
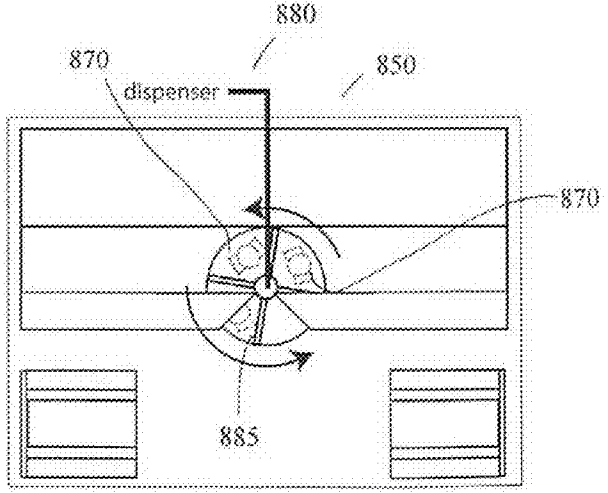

FIGS. 13*a*-13*d* show a indoor movie theatre 800 and method of operation. Inside the movie theater 800 audience members 810 may be positioned. Playing a movie comprises the use of a DVD player 820 built into the movie theater 800. FIG. 13*d* shows an outdoor drive-in style movie theater 830 having an integrated DVD player 840.

FIGS. 14*a*-14*e* show a front view, back view, side view and multiple top views, respectively, of a candy dispenser 850. The candy dispenser 850 includes a carousel 860 having multiple compartments 870 operable to retain a piece of candy 875. By turning the carousel 860 with arm 880, candy is exposed to an open area 885 from the top where it can be retrieved by an interested party. The release of the candy may require payment via the cards and card readers 420 or may be programmed by an adult to release on a pre-established schedule.

FIGS. 15*a*-15*d* show a front view, back view, side view and top view, respectively, of an emergency building 900 having emergency buttons 910, 920. The emergency buttons 910, 920 correspond to a police button and fire button, respectively.

The buildings and features set forth above are exemplary and not intended to be exhaustive. Other buildings and features include a jail requiring payment of bail, courthouse to resolve disputes with other players, clothing store, hospital, post office, construction trailer, grocery store, dance club, restaurants, barber salon, motel and hotel high rise, airport, school, flower shop, boat dock, train station, car dealership, bakery and apartment buildings. Other vehicles include police cars, ambulances, mail trucks, snow plow, bulldozer, dump truck, trash truck, cement truck, school bus, tour bus, city bus, street sweeper, sports cars, sedans, trucks and limousine.

Besides acting as a play, the play city 100 facilitates a game as detailed below. In general, the objective of a game facilitated by the play city 100 is to collect the most wealth via rents, property sales, including residences and businesses, and the operation of businesses. In one embodiment, during game play, the play city 100 comprises the city hall building, the bank building, airport, car dealership, boat dock, homes, stores, hotel, motel, apartment building, vehicles, human figures, play money, bankcards, dice, title cards, lucky cards and unlucky cards.

Lucky cards include cards dedicated to opportunities to purchase buildings, businesses or homes at a discounted price; free buildings, businesses or homes; bonus monies; police ticket or bail credit; safe credits; opportunities to purchase vehicles, watercrafts, or aircrafts at a discounted price; and free vehicles, watercrafts, planes or helicopters.

Unlucky cards include tax payments on real and personal property or savings; forfeit ticket or bail credit; donating money to other players; and requiring players to pay bank fees.

To start play, buildings are turned to an automatic mode and twenty lucky and twenty unlucky cards are placed face down in their respective tray. Each player first selects a game piece and begins with a pre-established cash fund (e.g., $50,000). The game can end in one of two ways as determined by the players. First, the game is played for a set time limit and the wealthiest player at the end of the time limit is declared the winner. Second, the game is played until everyone, except one player, is bankrupt as defined by the game. Bankruptcy occurs when all player assets are encumbered in full by bank loans, the player is unable to pay tickets or bail, debt from a lost court case, rent or their employees.

A player is designated to start the game based on a highest roll of two dice. Two six-sided game dice include a "U" (unlucky), "L" (Lucky) or a blank. A roll comprising two Us require the player to select an unlucky card while two Ls require the player to select a lucky card. All other combinations have no game impact. Random opportunities presented during a player's roll may be seized by the player, offered for sale or forfeited. Opportunities are only available to the player currently rolling the game dice. Players may seek to sell assets at any time. Players may borrow money from the bank but it must be secured by collateral such as a house, watercraft, business or other property. Game rules are flexible and may be amended to better suit the players' desires and age groups.

Although the invention has been described in detail with reference to several embodiments, additional variations and modifications exist within the scope and spirit of the invention as described and defined in the following claims.

I claim:

1. A system comprising:

a control unit operable to control certain activities within a play city;

a foundation;

a series of buildings having connector means for connecting the buildings to the foundation;

one or more card readers integrated with one or more of said buildings, said one or more card readers configured to read information from a corresponding card such that simulated stored funds are depleted responsive to a building activity being undertaken; and wherein the control unit controls the activities within the play city via wired and/or wireless connections.

2. The system of claim 1 wherein the control unit is one or more controllers, microprocessors, processors and/or computers.

3. The system of claim 1 wherein the foundation comprises a plurality of planer connectable members each having a connector on one or more edges thereof.

4. The system of claim 3 wherein the connectable members comprise streets, intersections and/or building foundations.

5. The system of claim 3 wherein the connectable members include street light and stop light connectors for receiving street lights and stop lights, respectively.

6. The system of claim 5 wherein the control unit controls the street lights and stop lights.

7. The system of claim 1 wherein the control unit is housed within one of the buildings.

8. The system of claim 1 further comprising card readers integrated into certain buildings, said card readers operable to allow users to purchase goods and/or services within the play city, said card readers adapted to receive a one or more corresponding cards.

9. The system of claim 1 further comprising an audio device operable to disseminate audio sounds and/or messages.

10. The system of claim 1 wherein at least one building is a movie theatre having an integrated DVD player.

11. The system of claim 1 further comprising means for generating smoke integrated into one or more buildings.

12. The system of claim 1 further comprising a plurality of vehicles.

13. The system of claim 12 wherein the vehicles are automobiles, tow trucks and/or fire and police vehicles.

14. The system of claim 13 wherein the fire and police vehicles include an integrated card holder and/or card reader.

15. The system of claim 14 wherein a card adapted to be swiped through the card reader is operable to cause a simulated fire and police and fire alarms to stop.

16. The system of claim 12 further comprising human figures for placement in the vehicles.

17. The system of claim 12 wherein the vehicles including a locking mechanism operable to prevent them from moving.

18. The system of claim 17 wherein the vehicles include an opening for receipt of a tool to unlock the vehicle.

19. The system of claim 12 wherein the vehicles are chargeable via a wireless charging bay.

20. The system of claim 1 wherein the one or more buildings include fire and/or burglar alarms.

21. The system of claim 1 wherein the one or more buildings include locks having corresponding keys.

22. The system of claim 3 further comprising members acting as hills or mountains.

23. The system of claim 1 further comprising one or more buildings in the form of houses, gas stations, drive-ins, fire station, police station, stores, restaurants and/or banks.

24. The system of claim 23 wherein the banks include card readers, calculators, processors and a money holding area.

25. The system of claim 23 further comprising garages attached to the houses wherein a garage door is operated via a remote device or an integrated button.

26. The system of claim 1 further comprising a candy dispenser accessible at certain times or at pore-programmed times.

27. The system of claim 1 further comprising means for starting one or more simulated fires in one or more buildings.

28. The system of claim 27 wherein the fire trucks are operable, when parked near a fire scene, to transmit a signal causing a fire to automatically cease.

29. The system of claim 1 wherein the system facilitates the play of a game.

30. The system of claim 29 wherein the game utilizes cards designated as lucky, unlucky and/or blank.

31. A system comprising:

a processor;

a series of planar connectable members operable to connect to one another to form a play city foundation;

a series of buildings having connector means for connecting the buildings to certain of the connectable members;

one or more card readers integrated with one or more of said buildings, said one or more card readers configured to read information from a corresponding card such that simulated stored funds are depleted responsive to a building activity being undertaken; and wherein the control unit is operable to control certain activities within the play city.

32. The system of claim 31 wherein each planer member has a connector device on one or more edges thereof.

33. The system of claim 31 wherein the planar members comprise streets, intersections and/or building foundations.

34. The system of claim 31 wherein the planar members include street light and stop light connectors for receiving street lights and stop lights, respectively.

35. The system of claim 34 wherein the processor controls the street lights and stop lights.

36. The system of claim 31 wherein the processor is housed within one of the buildings.

37. The system of claim 31 wherein the processor controls certain activities within the city via a wireless connection.

38. The system of claim 31 further comprising an audio device operable to disseminate audio messages and sound effects.

39. The system of claim 31 wherein at least one building is a movie theatre having an integrated DVD player.

40. The system of claim 31 wherein one or more of the buildings include means for generating smoke.

41. The system of claim 31 further comprising a plurality of vehicles.

42. The system of claim 41 wherein the vehicles are automobiles, tow trucks and/or fire and police vehicles.

43. The system of claim 42 wherein the fire vehicles include an integrated card holder and/or card reader.

44. The system of claim 43 wherein a card adapted to be swiped through said card reader is operable to cause a simulated fire to stop.

45. The system of claim 41 wherein the vehicles accommodate human figures for placement in the vehicles.

46. The system of claim 41 wherein the vehicles including a locking mechanism operable to prevent them from moving.

47. The system of claim 41 wherein the vehicles include an opening for receipt of a tool to unlock the vehicle.

48. The system of claim 41 wherein the vehicles are chargeable via a wireless charging bay.

49. The system of claim 31 wherein the one or more buildings include alarms.

50. The system of claim 31 wherein the one or more buildings include locks having corresponding keys.

51. The system of claim 31 wherein the system is wired and/or wireless.

52. The system of claim 31 further comprising members acting as hills or mountains.

53. The system of claim 31 further comprising one or more buildings in the form of houses, gas stations, drive-ins, movie theatres, restaurants, stores and/or banks.

54. The system of claim 53 further comprising garages attached to the houses wherein a garage door is operated via a remote device or an integrated button.

55. The system of claim 31 further comprising a candy dispenser accessible at certain times or at pore-programmed times.

56. The system of claim 31 wherein the system facilitates the play of a game.

57. The system of claim 56 wherein the game utilizes cards designated as lucky, unlucky and/or blank.

58. A system comprising:

a series of planar members connectable to one another to form a foundation for a play city, said planer members including building connectors;

a series of buildings having connector means for connecting the planar members via the building connectors;

a processor operable to control certain activities within the play city; and one or more card readers integrated with one or more of said buildings, said one or more card readers configured to read information from a corresponding card such that simulated stored funds are depleted responsive to a building activity being undertaken.

* * * * *